US010773539B2

(12) United States Patent
Mayade

(10) Patent No.: US 10,773,539 B2
(45) Date of Patent: Sep. 15, 2020

(54) TRANSFER PAPER FOR SUBLIMATION PRINTING, COMPRISING A CATIONIC AGENT

(71) Applicant: Ahlstrom-Munksjö Oyj, Helsinki (FI)

(72) Inventor: Thierry Mayade, Paladru (FR)

(73) Assignee: Ahlstrom-Munksjö Oyj, Helsinki (FI)

( * ) Notice: Subject to any disclaimer, the term of this patent is extended or adjusted under 35 U.S.C. 154(b) by 0 days.

(21) Appl. No.: 16/477,214

(22) PCT Filed: Jan. 10, 2018

(86) PCT No.: PCT/EP2018/050550
§ 371 (c)(1),
(2) Date: Jul. 11, 2019

(87) PCT Pub. No.: WO2018/130565
PCT Pub. Date: Jul. 19, 2018

(65) Prior Publication Data

US 2019/0366751 A1 Dec. 5, 2019

(30) Foreign Application Priority Data

Jan. 12, 2017 (FR) ..... 1750252

(51) Int. Cl.
*B41M 5/385* (2006.01)
*B41M 5/382* (2006.01)
*B41M 5/035* (2006.01)
*D06P 5/28* (2006.01)
*D06P 5/30* (2006.01)
*D06P 3/52* (2006.01)

(52) U.S. Cl.
CPC ..... *B41M 5/38235* (2013.01); *B41M 5/035* (2013.01); *D06P 5/006* (2013.01); *D06P 5/30* (2013.01); *D06P 3/52* (2013.01)

(58) Field of Classification Search
CPC .... B41M 5/38235; B41M 5/035; B41M 1/20; D06P 5/006; D06P 5/30
See application file for complete search history.

(56) References Cited

U.S. PATENT DOCUMENTS 5,958,579 A 9/1999 Idei et al.
2008/0229962 A1* 9/2008 Shedd ..... B41M 5/0256 101/487
2009/0068485 A1 3/2009 Inaoka et al.

* cited by examiner

*Primary Examiner* — Eisa B Elhilo
(74) *Attorney, Agent, or Firm* — Edwin A. Sisson, Attorney at Law, LLC; Jeffrey J. Banyas

(57) ABSTRACT

The invention relates to transfer paper for sublimation printing, comprising a fibrous substrate, said transfer paper having one or more cationic agents on at least one face thereof, deposited on the fibrous substrate by means of surface treatment, the amount of cationic agent(s) being greater than or equal to 8% by dry weight of the total dry weight of the compound(s) added to the fibrous substrate by means of the surface treatment.

22 Claims, No Drawings

TRANSFER PAPER FOR SUBLIMATION PRINTING, COMPRISING A CATIONIC AGENT

PRIORITES AND CROSS REFERENCES

This Application claims priority from International Application No. PCT/EP2018/050550 filed on 10 Jan. 2018 and French Application No. 1750252 filed on 12 Jan. 2017, the teachings of each of which are incorporated by reference herein in their entirety.

The present invention relates to transfer papers for sublimation printing, and more particularly but not exclusively, to those printable by inkjet printing.

Sublimation printing makes it possible to provide an image on a support, such as a metal, glass, plastic or fabric surface, using sublimable inks When printing with sublimable inks, the sublimable inks can be printed directly onto the final support or they can be printed indirectly. In the case of indirect printing, the inks are first printed on paper, called transfer paper, then the image printed on the transfer paper is transferred to the final support using transfer presses. Application US 2008/0229962 describes such a printing process.

Applications EP 2965919 A1, WO00/06392, WO2008/006434 and WO2016/074671 disclose transfer papers for sublimation printing.

More specifically, application EP 2965919 A1 discloses a transfer paper comprising a reservoir layer having an outer face configured to receive a sublimable ink, and a barrier layer applied to the inner face of the reservoir layer and configured to form a barrier to the vehicle of the sublimable ink. The reservoir layer may further comprise a cationic polymer in a small proportion to fix the dyes in the sublimable ink on the surface of the transfer paper.

Application WO00/06392 describes a transfer paper comprising a barrier layer having a porosity of at most 100 ml/min.

Application WO2008/006434 discloses a paper having a layer comprising a semi-synthetic polymer with thermoplastic properties.

Application WO2016/074671 describes a paper having a layer comprising thermoplastic particles.

Transfer papers for sublimation printing by inkjet printing generally comprise a barrier layer the basis of which is a hydrophilic polymer such as carboxymethyl cellulose, starch or polyvinyl alcohol, loaded to a greater or lesser degree with low specific surface area pigments such as kaolin or calcium carbonate, or high specific surface area pigments such as silicas.

The presence of a hydrophilic polymer-based barrier layer leads to a long drying time, limiting printing speeds and causing colour mixing and feathering, impairing the print quality.

Loading makes it possible to alleviate the aforementioned disadvantages, but results in an additional formulation cost and/or a limitation of transfer rates by sublimation.

There is therefore an as yet unmet need for a means of obtaining a transfer paper for sublimation printing that can be printed by inkjet, having good printability with a limited drying time, a high transfer rate and a relatively low weight, specifically less than or equal to 50 g/m$^2$.

The invention seeks to address this need and achieves this thanks to a transfer paper for sublimation printing comprising a fibrous substrate, the transfer paper having on a least one face one or more cationic agents, deposited by means of a surface treatment on the fibrous substrate, the quantity of the cationic agent or agents being greater than or equal to 8%, for example greater than or equal to 9% or even 10% by dry weight of the total dry weight of the compound or compounds furnished by the surface treatment on the fibrous substrate.

The invention also relates to a transfer paper for sublimation printing, having on at least one face at least 0.2 g/m$^2$ of one or more cationic agents, the transfer paper being free on this face from pigment, binder and other formulation ingredients such as dispersant, wetting agent, thickener, insolubilizing agent, sizing agent, optical brightener or dye, or the transfer paper comprising on this face one or more pigments and/or binders and/or other formulation ingredients such as dispersant, wetting agent, thickener, insolubilizing agent, sizing agent, optical brightener or dye, in an individual, or better total, quantity less than or equal to 13 times, in g/m$^2$, the quantity of cationic agent(s), for example less than or equal to 12 times, or even 10 times, 8 times or 5 times.

Cationic agents are usually used in small proportions as ink fixing agents for inkjet printing with the aim of keeping the ink on the surface and avoiding bleeding of the ink in water. The presence of a cationic agent in a higher proportion in the invention unexpectedly makes it possible to ensure a good transfer by sublimation, surprisingly little ink being retained in the transfer paper during sublimation.

The transfer paper according to the invention has good printability, thank in particular to the immobilisation of the ink on the surface by the cationic agent or agents.

The immobilisation of the ink pigments on the surface of the fibrous substrate by the cationic agent or agents improves the optical density after transfer and limits feathering. Definition is therefore improved.

The absence or scarcity of pigment, binder and any other formulation agents such as those listed above makes it possible to optimise the ink fixation/drying speed compromise.

The surface treatment may be single-layer or multi-layer.

The quantity of the cationic agent or agents is advantageously greater than or equal to 8%, even 9% or 10%, by dry weight of the total dry weight of the compound or compounds furnished by the application of the layer or layers of surface treatment, as indicated above.

The transfer paper may be free, at least on the face having the cationic agent or agents, from mineral load, also called pigment, or may have on this face one or more mineral loads in a quantity less than or equal to 10 g/m$^2$.

The mineral load or loads may be chosen from calcium carbonate, calcined kaolin, talc, $TiO_2$, hydroxides, in particular aluminium $Al(OH)_3$ or magnesium, sulphates, in particular $BaSO_4$ or $CaSO_4$, natural or synthetic aluminium silicate, aluminium oxide, and mixtures of the same. The mineral loads help to hold the ink on the surface. The presence of the cationic agent or agents as described in the present invention makes it possible to dispense with the presence of mineral loads, or at least to limit their quantity.

The transfer paper may be free, at least on the face having the cationic agent or agents, from binder, or may have on this face one or more binders in a quantity less than or equal to 8 g/m$^2$.

The binder or binders, preferably chosen from water-soluble binders such as polyvinyl alcohol, starch, gelatine, soy or casein proteins, and mixtures of the same.

The cationic agent or agents may be present on only one face of the transfer paper, that intended to receive the print.

The cationic agent or agents may be organic cationic agents.

The cationic agent or agents may be chosen from epichlorhydrin polyamines, in particular polyepichlorhydrin dimethylamines, poluethyleneimine and organic quaternary ammonium salts, the organic cationic agent of preference among the organic quaternary ammonium salts being in particular polydiallyldimethylammonium chloride, also called PolyDADMAC. The cationic agent or agents may be present on said face in a quantity greater than or equal to 0.2 $g/m^2$, particularly greater than or equal to 0.6 $g/m^2$.

Said face may also comprise one or more alkaline earth salts, in particular chosen from the calcium salts, preferably either calcium chloride or calcium nitrate, and the magnesium salts, in particular either magnesium sulphate or magnesium chloride, which may also contribute to improving transfer.

The fibrous substrate prior to treatment may be free from cationic agent and/or mineral load and/or binder and/or formulations agents such as dispersant, wetting agent, thickener, insolubilizing agent, sizing agent, optical brightener or dye. The fibrous substrate may comprise natural and/or synthetic fibres, in particular long and/or short cellulose fibres.

The transfer paper is preferably printable by inkjet printing. The transfer paper may also be printable by rotary press.

The transfer paper preferably has a Bendtsen air permeability greater than or equal to 100 ml/min, in particular greater than or equal to 200 ml/min (according to standard ISO 5636-3).

This air permeability gives the paper an open structure. It ensures fast drying of the ink applied to the transfer paper. It therefore results in a productivity gain with respect to a lower air permeability thanks to the increased ink drying speed.

The transfer paper may have a weight between 25 150 $g/m^2$ inclusive, in particular between 30 and 75 $g/m^2$ inclusive, with less than or equal to 50 $g/m^2$ being preferred.

The transfer paper is generally single-use.

In one embodiment, the cationic agent or agents are present on said face in a quantity greater than or equal to 0.2 $g/m^2$, the transfer paper being free, on said face, from pigment, binder and formulation agents such as dispersant, wetting agent, thickener, insolubilizing agent, sizing agent, optical brightener or dye, or the transfer paper comprising on said face one or more pigments and/or binders and/or formulation agents such as the above in an individual, or better total, quantity less than or equal to 13 times, in $g/m^2$, the quantity of cationic agent(s), and in particular less than or equal to 12 times, 10 times, 8 times or 5 times.

The invention also relates to a manufacturing process for a transfer paper for sublimation printing, in particular as defined above, in which a surface treatment deposits on at least one face of a fibrous substrate one or more cationic agents, the quantity of the cationic agent or agents being greater than or equal to 8%, in dry weight, of the total dry weight of the compound or compounds furnished by the surface treatment on the fibrous substrate, in particular greater than or equal to 9% or 10%.

The invention also relates to a manufacturing process for a transfer paper for sublimation printing, in particular as defined above, in which a surface treatment deposits on at least one face of a fibrous substrate one or more cationic agents, the treated face of the transfer paper comprising the cationic agent or agents in a quantity greater than or equal to 0.2 $g/m^2$, the transfer paper being free, on this face, from pigment, binder and formulation agents such as dispersant, wetting agent, thickener, insolubilizing agent, sizing agent, optical brightener or dye, or the transfer paper comprising on said face one or more pigments and/or binders and/or formulation agents such as the above in an individual, or better total, quantity less than or equal to 13 times, in $g/m^2$, the quantity of cationic agent(s), and in particular less than or equal to 12 times, 10 times, 8 times or 5 times.

The surface treatment may be single-layer or multi-layer.

The process according to the invention may include the manufacture of the fibrous substrate.

The surface treatment may be applied in-line or off-line.

The cationic agent or agents may be deposited on a single face of the fibrous substrate.

A composition comprising the cationic agent or agents may be deposited on said face of the fibrous substrate by the surface treatment, and the quantity of the composition deposited on the face of the fibrous substrate may be between 0.2 and 15 $g/m^2$ inclusive in dry weight, preferably between 0.5 and 8 $g/m^2$.

The surface treatment may be applied using a size press, a film transfer press or a coating system, in particular a curtain, knife, air-knife, pencil or even gravure roll coating system.

The invention also relates to a printed transfer paper for sublimation printing, comprising a transfer paper as defined above and at least one print on the face of the transfer paper comprising the cationic agent or agents, in particular an inkjet print with at least one sublimable ink.

The invention also relates to a printing process for a transfer paper for sublimation printing, in which the face comprising the cationic agent or agents of a transfer paper as defined above is printed with at least one ink, in particular by inkjet printing.

In a variant, the printing may be performed by rotary press.

The printing may be carried out, for example, in four colours with ink cartridges containing ink in primary colours, in particular black, magenta, yellow and cyan, and potentially secondary colours. The ink is formulated in particular from water-based sublimable pigments.

The invention further relates to a decoration process for a support, in which the print is transferred by sublimation from a printed transfer paper as described above to the support.

The support may be a metal, glass, plastic or fabric surface, in particular a fabric containing polyester, preferably a majority-polyester fabric.

EXAMPLES

The compositions described in the table below are each deposited using a Meyer rod on one face of a fibrous substrate, the composition and characteristics of which are described below. The fibrous substrates treated with the compositions form transfer papers.

Base paper prior to coating

Fibrous composition: 30% softwood+70% mixed short fibres

Basis weight=60 $g/m^2$

Cobb size 60 s=15 $g/m^2$

Bendtsen porosity=1500 ml/min

Coating formulations: composition and deposition per the table below

The printing test is conducted on the paper with the help of a SAWGRASS SG400 printer and the transfer is performed in a press at 200° C. for one minute on a polyester fabric.

A black ink (SAWGRASS Sublijet black) is deposited on the face of the fibrous substrate treated with the composition.

A black flat tint is thus obtained. The transfer papers treated with the ink form the imprinted transfer papers.

The optical density after transfer to the polyester fabric is measured using an X-rite 500 spectrodensitometer.

The parts are expressed as dry weights.

| | | Example 1 | Example 2 | Example 3 | Example 4 | Example 5 |
|---|---|---|---|---|---|---|
| Calcium carbonate | (parts) | 20 | 20 | 2080 | 0 | 0 |
| Aluminium silicate | (parts) | 80 | 80 | 0 | 0 | 0 |
| Polyvinyl alcohol | (parts) | 12 | 12 | 17 | 0 | 0 |
| Cationic agent - type | | — | PolyDADMAC | PolyDADMAC | PolyDADMAC | Polyepichlorhydrin dimethylamine |
| Cationic agent - quantity | (parts) | 0 | 40 | 40 | 100 | 100 |
| Dry deposition | ($g/m^2$) | 1.36 | 2.66 | 1.93 | 2.3 | 1.8 |
| Cationic agent dry weight | ($g/m^2$) | 0 | 0.7 | 0.51 | 2.3 | 1.8 |
| Optical density (black flat tint) | | 1.86 | 2.14 | 2.21 | 2.20 | 2.22 |

In example 3, "20+80" indicates that 20 parts of ground $CaCO_3$ and 80 parts of PCC (precipitated calcium carbonate) are used.

The Bendtsen air permeability of examples 2 to 5 is greater than 100 ml/min.

Note that the transfer papers printed according to the invention in examples 2, 3, 4 and 5 have an optical density greater than the transfer paper printed according to comparative example 1, which is not according to the invention.

The invention claimed is:

1. Transfer paper for sublimation printing comprising a fibrous substrate, the transfer paper having on a least one face one or more cationic agents, deposited by means of a surface treatment on the fibrous substrate, the quantity of the cationic agent or agents being greater than or equal to 8% by dry weight of the total dry weight of the compound or compounds furnished by the surface treatment on the fibrous substrate.

2. Transfer paper according to claim 1, the quantity of the cationic agent or agents being greater than or equal to 9% by dry weight of the total dry weight of the compound or compounds furnished by the surface treatment on the fibrous substrate.

3. Transfer paper for sublimation printing according to claim 1, having on at least one face at least 0.2 $g/m^2$ of one or more cationic agents, the transfer paper being free on this face from pigment, binder and formulation agents, or the transfer paper comprising on this face one or more pigments and/or binders and/or formulation agents in a quantity less than or equal to 13 times, in $g/m^2$, the quantity of cationic agent(s).

4. Paper according to claim 3, the transfer paper comprising on said face one or more pigments and/or binders and/or formulation agents in a total quantity less than or equal to 12 times, in $g/m^2$, the quantity of cationic agent(s).

5. Transfer paper according to claim 1, the cationic agent or agents being present on said face in a quantity greater than or equal to 0.2 $g/m^2$ of one or more cationic agents, the transfer paper being free on this face from pigment, binder and formulation agents, or the transfer paper comprising on this face one or more pigments and/or binders and/or formulation agents in a quantity less than or equal to 13 times, in $g/m^2$, the quantity of cationic agent(s).

6. Transfer paper according to claim 1, the transfer paper being free from mineral load at least on the face having the cationic agent or agents, or having on this face one or more mineral loads in a quantity less than or equal to 10 $g/m^2$.

7. Transfer paper according to claim 1, the transfer paper being free from binder at least on the face having the cationic agent or agents, or having on this face one or more binders in a quantity less than or equal to 8 $g/m^2$.

8. Transfer paper according to claim 1, the transfer paper being printable by inkjet printing.

9. Transfer paper according to claim 1, the cationic agent or agents being organic cationic agents.

10. Transfer paper according to the claim 9, the cationic agent or agents being chosen from epichlorhydrin polyamines.

11. Transfer paper according to claim 9, the cationic agent or agents being present on said face in a quantity greater than or equal to 0.2 $g/m^2$.

12. Transfer paper according to claim 1, having a Bendtsen air permeability greater than or equal to 100 ml/min.

13. Transfer paper according to claim 1, having a weight between 25 and 150 $g/m^2$.

14. Manufacturing process for a transfer paper for sublimation printing according to claim 1, in which a surface treatment deposits on at least one face of a fibrous substrate one or more cationic agents, the quantity of the cationic agent or agents being greater than or equal to 8%, in dry weight, of the total dry weight of the compound or compounds furnished by the surface treatment on the fibrous substrate.

15. Manufacturing process according to claim 14 for a transfer paper for sublimation printing, in which a surface treatment deposits on at least one face of a fibrous substrate one or more cationic agents, the treated face of the transfer paper comprising the cationic agent or agents in a quantity greater than or equal to 0.2 $g/m^2$, the transfer paper being free, on this face, from pigment, binder and formulation agents, or the transfer paper comprising on said face one or more pigments and/or binders and/or formulation agents quantity less than or equal to 13 times, in $g/m^2$, the quantity of cationic agent(s).

16. Manufacturing process for a transfer paper according to claim 14, in which the fibrous substrate is manufactured and the surface treatment applied in-line or off-line.

17. Manufacturing process for a transfer paper according to claim 14, in which the surface treatment deposits a composition comprising the cationic agent or agents on said face of the fibrous substrate.

18. Manufacturing process for a transfer paper according to claim 17, the quantity of the composition deposited on the face of the fibrous substrate being between 0.2 and 15 $g/m^2$ by dry weight.

19. Manufacturing process for a transfer paper according to claim 17 or 18, the surface treatment being applied using a size press, a film transfer press or a coating system.

20. Printed transfer paper for sublimation printing, comprising a transfer paper according to claim 1 and at least one print on the face of the transfer paper comprising the cationic agent or agents.

21. Printing process for a transfer paper for sublimation printing, in which the face comprising the cationic agent or agents of a transfer paper according to claim 1 is printed with at least one ink.

22. Process for decorating a support, wherein the printing on a transfer paper printed according to claim 21 is transferred to the support by sublimation.

* * * * *